US007331078B2

(12) United States Patent
Grey

(10) Patent No.: US 7,331,078 B2
(45) Date of Patent: Feb. 19, 2008

(54) SURFACE CLEANING APPARATUS

(75) Inventor: Nicholas Gerald Grey, Crowle (GB)

(73) Assignee: Grey Technology Limited, Worcester (GB)

( * ) Notice: Subject to any disclaimer, the term of this patent is extended or adjusted under 35 U.S.C. 154(b) by 0 days.

(21) Appl. No.: 11/055,749

(22) Filed: Feb. 11, 2005

(65) Prior Publication Data

US 2005/0217043 A1 Oct. 6, 2005

Related U.S. Application Data

(60) Division of application No. 10/700,674, filed on Nov. 5, 2003, which is a continuation of application No. 10/450,001, filed as application No. PCT/GB02/03309 on Jul. 19, 2002.

(30) Foreign Application Priority Data

Jul. 20, 2001 (GB) ..... 0117722.9
Nov. 17, 2001 (GB) ..... 0127652.6

(51) Int. Cl.
*A47L 9/04* (2006.01)

(52) U.S. Cl. ..... 15/42; 15/377; 15/385; 15/389

(58) Field of Classification Search ..... 15/41.1, 15/42, 43, 52.1, 344, 377, 383, 385; 55/DIG. 3; *A47L 7/02*

See application file for complete search history.

(56) References Cited

U.S. PATENT DOCUMENTS 2,235,432 A 3/1941 Kenyon
3,184,775 A 5/1965 Downey et al.
3,460,188 A 8/1969 Boyd
3,906,585 A 9/1975 Mattsson
3,978,539 A 9/1976 Yonkers et al.
4,099,284 A 7/1978 Shinozaki et al.
4,177,533 A 12/1979 Liebscher et al.
4,369,539 A 1/1983 Nordeen
4,457,042 A 7/1984 Jones et al.
5,101,534 A 4/1992 Watanabe et al.
5,224,232 A 7/1993 Zahuranec et al.
5,765,258 A 6/1998 Melito et al.
5,896,611 A * 4/1999 Haaga ..... 15/42

FOREIGN PATENT DOCUMENTS

DE 18 14 398 9/1970
DE 7203819 7/1972

(Continued)

OTHER PUBLICATIONS

International Search Report dated Aug. 25, 2004 for Application No. EP 04 01 1243.

(Continued)

*Primary Examiner*—Theresa T. Snider
(74) *Attorney, Agent, or Firm*—Womble Carlyle Sandridge & Rice, PLLC

(57) ABSTRACT

A surface cleaning apparatus comprises a body including a rear compartment, a forward compartment and an intermediate compartment arranged between the rear and forward compartments. An elongate rotatable brush arrangement is positioned within and extends across the forward compartment. An electric motor is positioned in the rear compartment, and drive means extends between the rotatable brush arrangement and the electric motor.

40 Claims, 8 Drawing Sheets

FOREIGN PATENT DOCUMENTS

| | | | |
|---|---|---|---|
| DE | 2239135 | | 2/1974 |
| DE | 196 01 976 | | 7/1997 |
| DE | 199 14 574 | | 11/2000 |
| EP | 0 285 096 | | 10/1988 |
| EP | 319 758 | A2 | 6/2003 |
| FR | 2 228 459 | | 12/1974 |
| FR | 2778079 | | 11/1999 |
| GB | 1 533 494 | | 7/1975 |
| GB | 1 442 587 | | 7/1976 |
| GB | 1 547 286 | | 6/1979 |
| GB | 2 137 486 | | 10/1984 |
| GB | 2 318 279 | | 4/1998 |
| GB | 2351435 | A | 1/2001 |
| JP | 49-55164 | | 5/1974 |
| JP | 52-43378 | | 9/1975 |
| JP | 55-96126 | | 7/1980 |
| JP | 4322625 | | 11/1992 |
| JP | 10-201682 | * | 8/1998 |
| JP | 11-276392 | | 10/1999 |
| JP | 1999-0078370 | | 10/1999 |
| WO | WO 03/024292 | | 3/2003 |

OTHER PUBLICATIONS

International Search Report dated Aug. 25, 2004 for Application No. EP 04 01 1244.

* cited by examiner

SURFACE CLEANING APPARATUS

FIELD OF THE INVENTION

This invention relates to a surface cleaning apparatus, such as for a floor or upholstery, incorporating an elongate rotatable brush arrangement and an electric motor for rotating the brush.

BACKGROUND OF THE INVENTION

Current surface cleaning apparatus generally employs suction means. One of the drawbacks of such suction means is that the fans used to generate suction are relatively inefficient, i.e. typically 10 to 12 percent efficient in use, with the result that such apparatus tends not to be easily portable. This is especially the case where the apparatus incorporates batteries for powering the motor. It is therefore not practical to incorporate batteries of sufficient power in a readily portable suction cleaner in order to provide the degree of suction required for effective cleaning.

It is known to provide surface cleaning apparatus, such as for sweeping, in which an elongate brush arrangement, sometimes known as a brush bar, is supported for rotation in a housing which is adapted to be propelled at least in a forwards direction. The brush arrangement generally extends transversely of the housing and is adapted to contact a surface beneath it. The brush arrangement is arranged to be rotated by friction resulting from propelling the housing across a floor. The housing can be provided with wheels which contact the surface. One of the drawbacks of such a construction is that the friction drive is not very effective.

It is also known to provide one or more auxiliary brush arrangements extending outwardly from one or two front corners of the housing. The auxiliary brush arrangement is provided for rotation about an axis inclined to the vertical and is provided with radial bristles. An auxiliary brush arrangement of this kind is described in GB-A-1 547 286. The auxiliary brush arrangement is freely rotatable and relies for its rotation on contact with the floor or a skirting board of a room during propulsion of the apparatus across the floor. Such means of rotation is unreliable and results in particles of dust and/or dirt on the floor being flicked towards the elongate rotating brush assembly for collection by the apparatus. Furthermore, contact of the circular auxiliary brush arrangement with the floor or a skirting board results in bristles of the auxiliary brush arrangement which extend outwardly sideways from the housing undergoing angular rotation effectively in a backwards direction. This means that an auxiliary brush means extending outwardly from a front right hand corner of the housing, as viewed from above and behind the apparatus, would be rotated in a clockwise direction and would flick dust and or dirt around behind it in the direction of the elongate rotating brush arrangement. This is not very satisfactory.

SUMMARY OF THE INVENTION

It is therefore an object of the present invention to provide a surface cleaning apparatus which overcomes, or at least ameliorates, at least some of the problems of known apparatus.

According to a first aspect of the present invention there is provided a surface cleaning apparatus comprising:

a body comprising a rear compartment, a forward compartment and an intermediate compartment arranged between the rear and forward compartments;

an elongate rotatable brush arrangement positioned within and extending across the forward compartment;

an electric motor positioned in the rear compartment; and drive means extending between the rotatable brush arrangement and the electric motor.

A battery, such as a rechargeable battery, may be positioned in the rear compartment together with the electric motor. Alternatively, the electric motor may be mains powered.

The rotatable brush arrangement may extend substantially the entire width of the forward compartment.

The intermediate compartment may be provided with a removable closure, such as a removable side wall, for the removal of debris therefrom.

The drive means may pass at least partly through the intermediate compartment. The drive means may pass through a tunnel which passes at least partly through the intermediate compartment. The drive means may be positioned adjacent one side of the intermediate compartment.

The drive means may comprise a belt, for example a toothed belt, drive.

A wall may be provided between the rear compartment and the intermediate compartment to seal the rear compartment from the intermediate compartment.

A wall may be provided between the intermediate compartment and the forward compartment, the wall extending from the base of the intermediate compartment and terminating short of the top thereof. The top of the wall may be at substantially the same height as the top of the brush arrangement. The wall may be inclined rearwardly. The angle of inclination may be in the range of 15 to 20 degrees, for example.

The apparatus may incorporate handle means. The length of the handle means may be varied. For example, the handle means may be interchangeable. Thus, one handle means may be relatively short and another handle means may be relatively long. Alternatively, the other handle means may serve to extend the one handle means. The handle means, or at least the relatively long handle means, may be rotatable about the axis thereof to facilitate steering of the apparatus and/or may be pivotable about an axis transverse to the axial direction thereof.

An auxiliary brush arrangement may be provided at one side of the body of the apparatus. The auxiliary brush arrangement may extend outwardly from the forward compartment. The auxiliary brush arrangement may rotate about an axis inclined to the vertical. The auxiliary brush arrangement may be provided with radial bristles. The radial bristles may be inclined at an acute angle to the axis of rotation of the auxiliary brush arrangement. The auxiliary brush arrangement may be driven by the electric motor or by friction.

The forward compartment includes in the lower face thereof an aperture through which bristles of the brush arrangement protrude. A front part of the forward compartment may be movable to expose bristles at the front of the apparatus. For example, the cover may be removable or may be pivotable, or otherwise movable, to expose bristles at the front of the apparatus.

The rear compartment may be provided with ground-engaging wheels.

According to a second aspect of the present invention there is provided a surface cleaning apparatus comprising a body provided with an elongate rotatable brush arrangement, an electric motor and drive means extending between the rotatable brush arrangement and the electric motor, wherein the body is provided remote from the brush arrangement with one or more ground-engaging wheels.

The second aspect of the invention may incorporate features from the first aspect.

According to a third aspect of the present invention there is provided a surface cleaning apparatus comprising a housing provided with an elongate rotatable brush arrangement, wherein the housing is provided with a movable (including removable) cover for part of the brush arrangement.

Thus, the apparatus can clean surfaces that would not be possible with an apparatus having a front cover extending down to the level of the base of the apparatus and can, for example, clean the front faces of stair treads.

The third aspect of the invention may incorporate features from the first aspect.

According to a fourth aspect of the present invention there is provided a surface cleaning apparatus comprising a housing provided with an elongate rotatable brush arrangement, wherein bristles of the brush arrangement extend beneath the body to such an extent that the body can be inclined in use to increase contact between the bristles and a surface to be cleaned.

Thus, the housing may be inclined to increase contact between the bristles of the brush arrangement and the surface being cleaned or to increase the depth to which the bristles of the brush arrangement may penetrate the surface being cleaned.

The fourth aspect of the invention may incorporate features from the first aspect.

According to a fifth aspect of the present invention there is provided a surface cleaning apparatus comprising a body provided with an elongate rotatable brush arrangement, an electric motor and drive means extending between the rotatable brush arrangement and the electric motor, wherein the body is provided with handle means, the length of which handle means may be varied.

The fifth aspect of the invention may incorporate features from the first aspect.

According to a sixth aspect of the present invention there is provided a surface cleaning apparatus comprising a body provided with an elongate rotatable brush arrangement, an electric motor and drive means extending between the rotatable brush arrangement and the electric motor, wherein the body is provided with handle means mounted to be pivotable about a longitudinal axis thereof such that pivoting of the handle facilitates steering of the apparatus.

The sixth aspect of the invention may incorporate features from the first aspect.

According to a seventh aspect of the present invention there is provided surface cleaning apparatus comprising: a housing adapted to be propelled at least in a forwards direction on the surface; an elongate brush arrangement supported for rotation in and extending transversely of the housing and adapted to contact the surface; means to rotate the elongate brush arrangement; and at least one auxiliary brush means of substantially circular form extending outwardly from the housing and adapted to be rotatably driven by means within the housing, such that during rotation of the at least one auxiliary brush means, a peripheral region thereof angularly rotates to sweep debris into the path of the elongate brush arrangement.

The at least one auxiliary brush means may be arranged for rotation about a vertical axis or about an axis inclined to vertical.

The at least one auxiliary brush means may be arranged to extend outwardly from a right and/or left hand side of the housing. When such an auxiliary brush means extends outwardly from a right hand side of the housing, as viewed from above and behind the housing, the auxiliary brush means is arranged to be rotated in an anti-clockwise direction, as so viewed. When such an auxiliary brush means extends outwardly from a left hand side of the housing, as viewed from above and behind the housing, the auxiliary brush means is arranged to be rotated in a clockwise direction, as so viewed.

The at least one auxiliary brush means may be provided with radial bristles which may be inclined at an acute angle to an axis of rotation of the at least one auxiliary brush means.

The at least one auxiliary brush means may be rotatably driven by the elongate brush arrangement and suitably by gear means provided at at least one end of the elongate brush arrangement.

The at least one auxiliary brush means and/or the elongate brush arrangement may be adapted for rotation by means of at least one electric motor provided in the housing. Such at least one electric motor may be battery or mains operated.

Alternatively, the elongate brush arrangement may be adapted to be rotated by friction means resulting from propelling the housing across the surface, the elongate brush arrangement so rotated being adapted to rotate the at least one auxiliary brush means.

The housing may be provided with one or more wheels for engaging the surface and for enabling or assisting propulsion of the housing along the surface.

The housing may be provided with a compartment for receiving debris picked up from the surface by the elongate brush arrangement.

Alternatively, the housing may be provided with outlet means, such as a pipe or hose means, for directing debris, picked up from the surface by the elongate brush arrangement, into a receiving container, such as a bag, located elsewhere in or on the apparatus.

The housing may be adapted for demountable or fixed connection to suction hose means, such suction hose means being adapted to receive from the housing debris picked up from the surface by the elongate brush arrangement. The suction hose means may incorporate electrical wiring and connection means, by means of which one or more electric motors in the housing may be powered from a remote source, such as electric mains, or battery means.

The surface for cleaning by the apparatus of the present invention may be any surface which is to be swept and may be a floor, stairway, or upholstery, of premises or vehicles.

BRIEF DESCRIPTION OF THE DRAWINGS

For a better understanding of the present invention and to show more clearly how it may be carried into effect reference will now be made, by way of example, to the accompanying drawings in which.

DETAILED DESCRIPTION OF THE INVENTION

Figure 1:
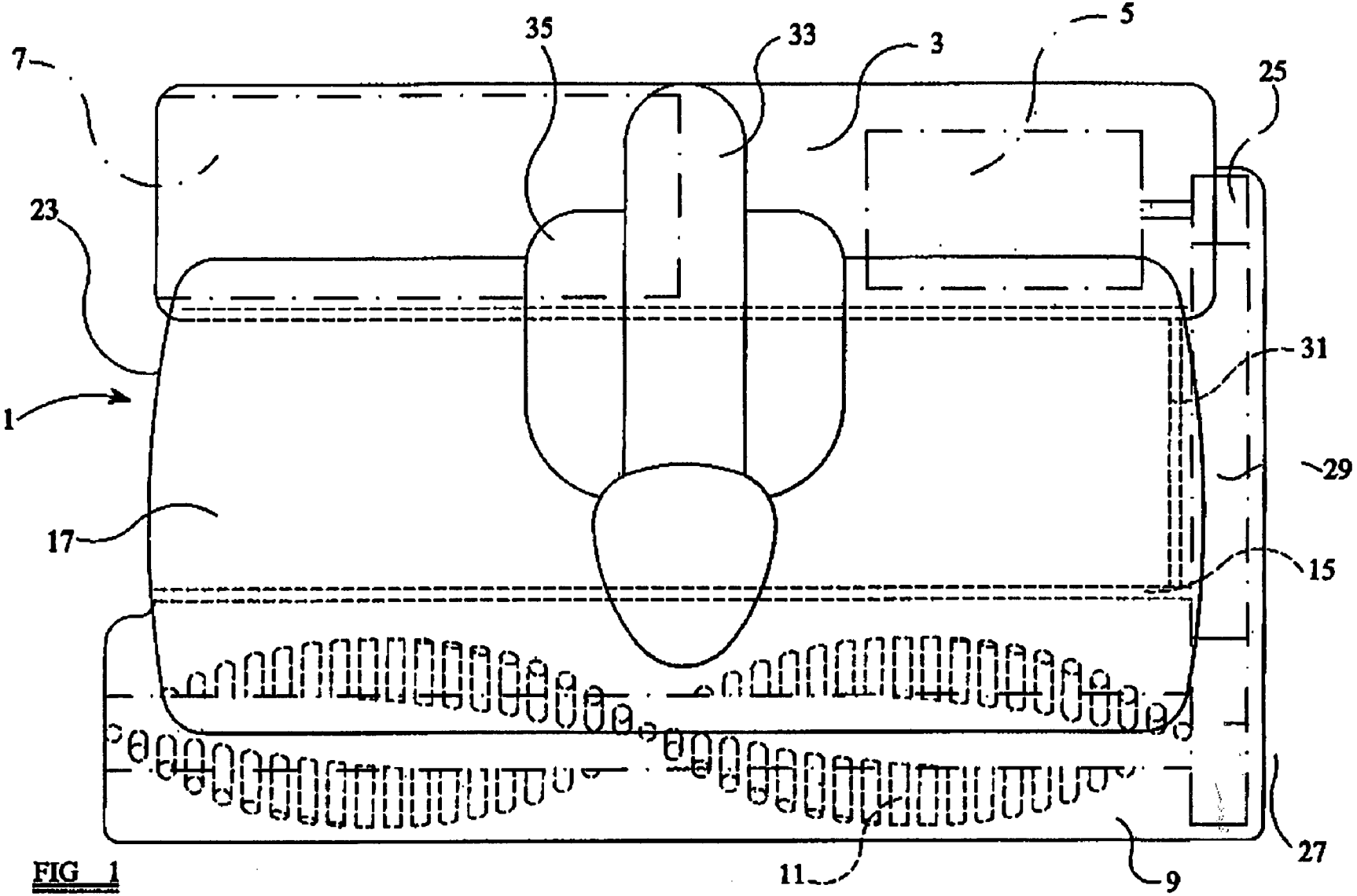
FIG. 1 is a plan view of one embodiment of a surface cleaning apparatus according to the present invention.
Figure 2:
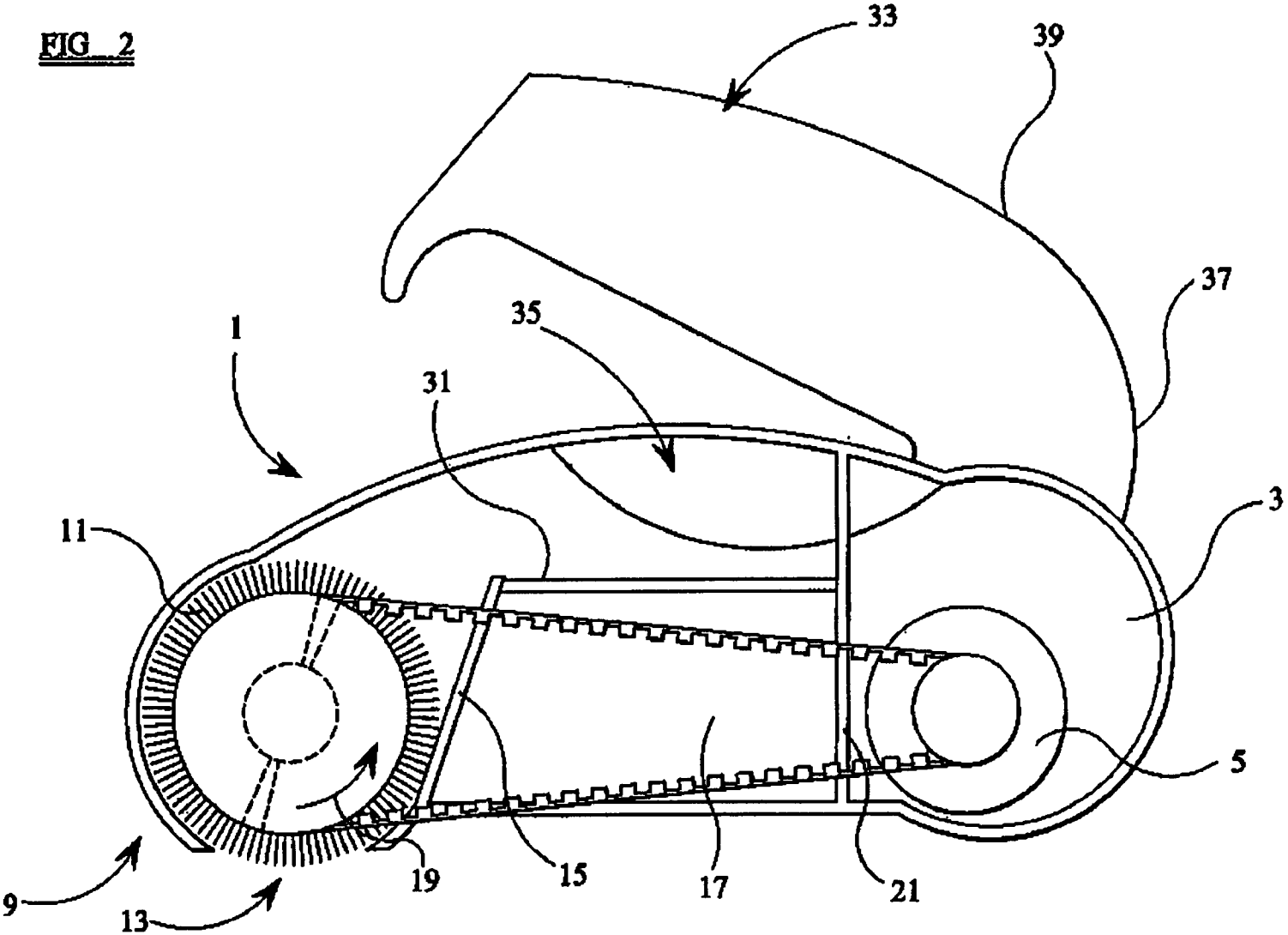
FIG. 2 is a side elevational view, partly in section, of the surface cleaning apparatus shown in FIG. 1.

The surface cleaning apparatus shown in FIGS. 1 and 2 comprises a body 1, suitably moulded of plastics material, and having effectively three compartments.

A rear compartment 3 houses an electric motor 5 and a rechargeable battery pack 7. The battery pack 7 may be connected to a main power supply (not shown) for recharging the battery pack. The battery pack may either be connected to the main supply whenever the apparatus is not in use or at suitable times when the battery pack has become depleted. Switch means (not shown) is provided to permit a user to energize and de-energize the motor 5 as desired. As an alternative to a rechargeable battery pack, the apparatus could employ disposable batteries or be main powered.

A forward compartment 9 houses an elongate rotatable brush arrangement 11. For convenience a forward wall of the forward compartment is arcuate and extends around the periphery of the brush arrangement 11. The bottom of the forward compartment is open at 13 to allow the bristles of the brush arrangement to contact a floor, carpet or the like over which the surface cleaning apparatus is to be moved. The rear of the forward compartment is a rearwardly inclined wall 15 which allows debris, such as dust, dirt and the like, to be propelled up the wall due to rotation of the brush arrangement 11 and to pass over the wall into an intermediate compartment 17 which will be described in more detail hereinafter. The wall 15 extends upwardly to about the same height as the top of the brush arrangement 11 and is angled rearwardly (i.e. away from the forward compartment) at an angle of inclination of from 15 to 20 degrees, preferably about 18 degrees. The precise angle is not important, but the inclination facilitates the passage of the debris up and over the wall and at the same time facilitates retention of the debris within the intermediate compartment 17. The brush arrangement extends substantially the entire width of the forward compartment and is provided with two helically arranged rows of bristles. The two rows are diametrically opposed and each row is in the form of a pair of separate helices which twist in opposite directions and meet substantially midway between the ends of the brush arrangement.

The intermediate compartment 17 is positioned between the wall 15 and a wall 21 which encloses the electrical components 5, 7 in the rear compartment 3, the wall 21 protecting the components in the rear compartment from the ingress of debris. The intermediate compartment 17 also has a lower wall, an upper wall and side walls formed by the outer wall of the body 1. Debris therefore accumulates within the intermediate compartment 17. The intermediate compartment is provided with a removable closure to facilitate the removal of debris. For example, one of the walls, such as a side wall, the upper wall or the lower wall, can be removed in order that the debris can be emptied from the intermediate compartment, the removed wall being replaced once the compartment has been emptied. Ideally, side wall 23 is removable for emptying purposes. The wall 15 provides the advantage that debris does not readily escape from the intermediate compartment 17 and, even if the body is inclined such that the forward compartment is below the intermediate compartment, the debris does not escape from the intermediate compartment.

The brush arrangement 11 is rotated by the motor 5 by way of toothed rollers 25, 27 attached to the motor and to the brush, respectively, and by way of a toothed belt 29, for example of elastomeric material, extending around the two rollers. The toothed belt 29 is enclosed within a tunnel 31 where it passes through the intermediate compartment 17 in order to prevent the ingress of debris into the rear compartment 3. The tunnel 31 may pass through the intermediate compartment 17 at any convenient point. However, particularly in the event side wall 23 is removable for emptying purposes, the tunnel may be arranged at that side of the intermediate compartment 17 remote from the side wall 23.

Figure 3:
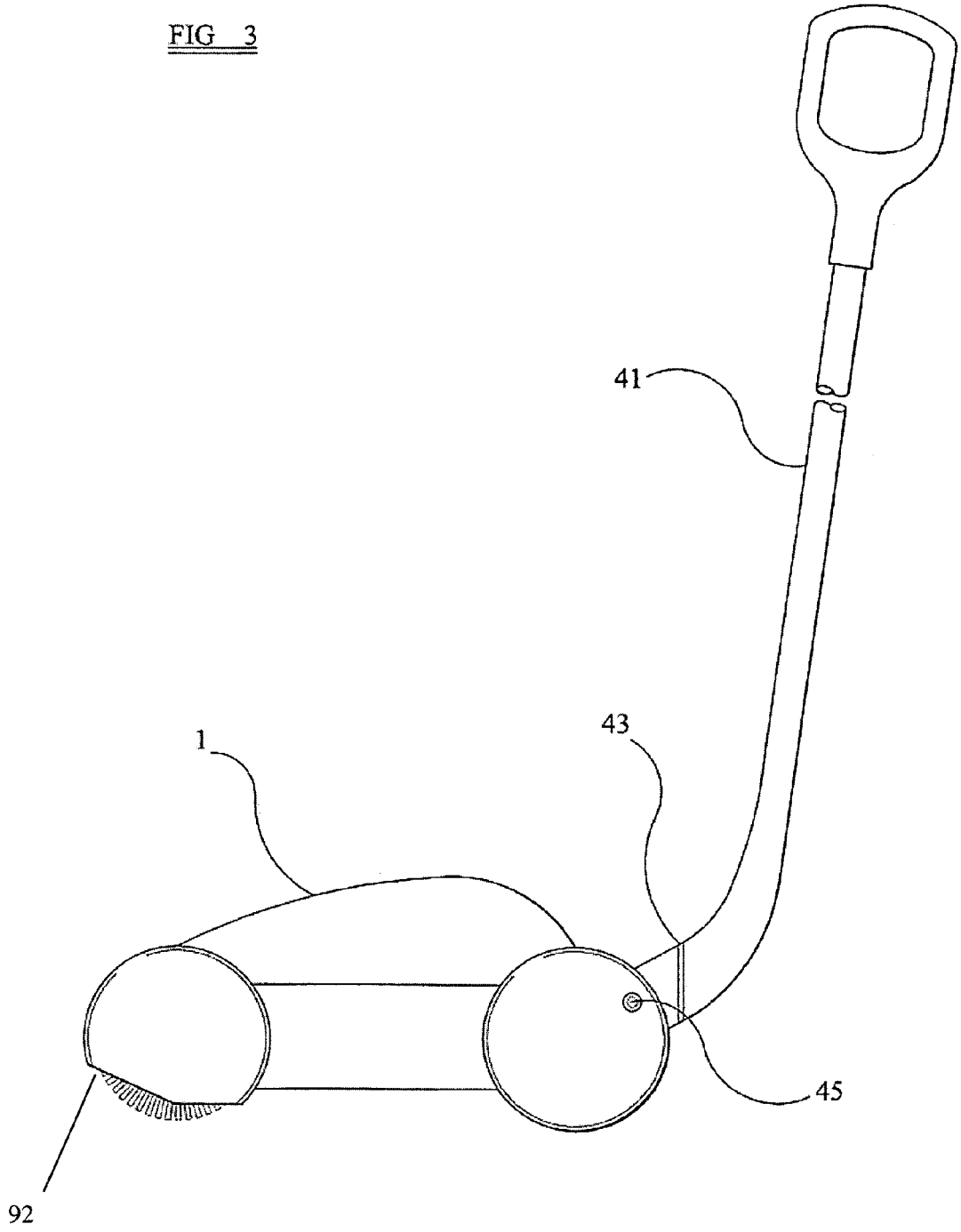
FIG. 3 is an elevational view of the surface cleaning apparatus of FIGS. 1 and 2 with an alternative handle.

A handle 33 is attached to the body 1 in the region of the rear compartment 3, the body being formed with a recess 35 beneath the handle to allow the handle to be gripped while maintaining a low profile for the surface cleaning apparatus. The handle 33 may be in two parts, a first part 37 which is secured to the body 1 and a second part 39 which can be removed from the first part and replaced by a longer handle part 41 as shown in FIG. 3. The longer handle part 41 is provided with swivel means 43 to allow the handle part 41 to rotate about the axis thereof relative to the body 1 and with pivot means 45 to allow the handle part to pivot about an axis transverse to the axial direction of the handle part to enable the surface cleaning apparatus to be steered by the user. As an alternative to interchangeable handles, the handle part 41 may be removably engageable with the handle part 33. In such a case, the handle part 33 is arranged such that the swivel means 43 functions only in certain positions of the handle part 33 in order that movement can be inhibited when the handle part 33 is used alone.

As will be apparent particularly from FIG. 3, the bristles of the brush arrangement 11 extend outwardly from the aperture in the forward compartment 9. In order to remove stubborn debris and/or to revitalize carpet the lower front region of the forward compartment may be chamfered 92, or the front region of the forward compartment may be movable (including removable), to increase the exposure of the bristles in this region. In this way, the forward part of the apparatus may be inclined relative to the surface to be cleaned, thereby increasing contact between the bristles and a surface to be cleaned and, on some surfaces, increasing the depth to which the bristles penetrate and clean the surface.

Although not shown, an auxiliary rotary brush may be provided at that side of the brush arrangement 11 which incorporates the roller 27 and the belt 29. Such an auxiliary brush is described, for example, in GB-A-1 547 286. Such an auxiliary brush is able to sweep debris into the path of the brush arrangement 11 which might otherwise be missed due to the lack of bristles in the region of the roller 27. The auxiliary brush may be driven by any suitable means, such as gearing from the brush arrangement 11 or by friction with the surface to be swept, and is suspended from and extends outwardly beyond the body 1. The auxiliary brush may comprise a cylindrical body rotatable about an axis which is inclined to the vertical by about 10 degrees so as to extend outwardly beyond the body 1. Bristles protrude radially outwardly from the periphery of the cylindrical body, but need not be perpendicular to the axis of rotation and may preferably be at an angle of about 80 degrees to the axis of rotation so as to form a cone which increases in cross-section with increasing distance from the body 1.

Although not shown, the front part of the forward compartment 9 may be removed to expose the bristles at the front of the apparatus. This effectively increases the aperture in the forward compartment which would seriously impair the effectiveness of a suction cleaner, but in the present invention can effectively be used to assist in the sweeping of stairs, cleaning upholstery and carpets in vehicles and the like operations where a greater exposed area of bristles can be useful. As an alternative to removing the front part of the compartment 9, the front part may be movable, for example pivotable or slidable, relative to the remainder of the compartment in order to expose the bristles.

Although not shown, the rear compartment 3 may be provided with ground-engaging wheels in order to assist mobility of the surface cleaning apparatus. The ground-engaging wheels may, for example, be formed externally in the side regions of the rear compartment 3 or may be provided within recesses formed at least partly beneath the rear compartment 3.

Although the illustrated embodiments of the present invention are intended primarily for domestic use, the surface cleaning apparatus can also be used outdoors or in workshops if desired. However, it may be preferable to provide a more rugged design specifically adapted for such use.

In use of the surface cleaning apparatus according to the invention, as shown in FIGS. 1 and 2, the apparatus is placed upon a surface to be swept, such as a carpet, and the switch operated to energize the motor and consequently to rotate the brush arrangement to sweep debris from the surface and then propel the debris up and over the inclined wall 15 and into the intermediate compartment 17 where it is temporarily stored. As the surface cleaning apparatus is moved over the surface with the brush arrangement 11 rotating in the direction denoted by arrow 19, any further debris is similarly swept from the surface and propelled up and over the wall 15 and into the intermediate compartment 17. The surface cleaning apparatus is extremely portable and can be employed wherever it may be required. For example, it can be used to sweep stairs without the need for electrical leads or suction hoses. The shape of the apparatus with the rounded shape of the rear compartment as illustrated facilitates movement of the apparatus over stairs, but ground engaging wheels may be provided to further facilitate such sweeping operations.

When the intermediate compartment 17 is to be emptied, one wall of the compartment is removed as explained above and the debris can readily be discharged. The removable wall is then replaced. Alternatively, the intermediate compartment may be in the form of a tray 190 as shown in FIG. 4, which can be removed and emptied so as to discharge debris.

When the surface cleaning apparatus is not in use it can be stored, for example either in a cupboard or the like or plugged into a main supply in order to recharge the battery 7.

Thus the surface cleaning apparatus of the present invention incorporates an electrically driven brush arrangement. The brush arrangement is not driven by frictional forces between the surface cleaning apparatus and the surface over which it is to be moved. Thus, efficiency of the apparatus is not dependent on the nature of the frictional contact. Further, the apparatus does not rely on suction means to draw the debris into a storage chamber. Thus, efficiency of the apparatus is not dependent on the effectiveness of suction means and the substantial power drain of suction means on the rechargeable battery is avoided. The provision of the motor at the rear of the apparatus eliminates the need for increased height should the motor be positioned over the compartment for collecting dust and the like and also provides effective full width cleaning which would not be possible if the motor was to be positioned within the compartment for collecting debris. In such a position, debris is likely to accumulate around the motor and cause blockages. The present invention overcomes this problem by passing the drive means for the brush arrangement at least partly through the debris compartment.

Figure 4:
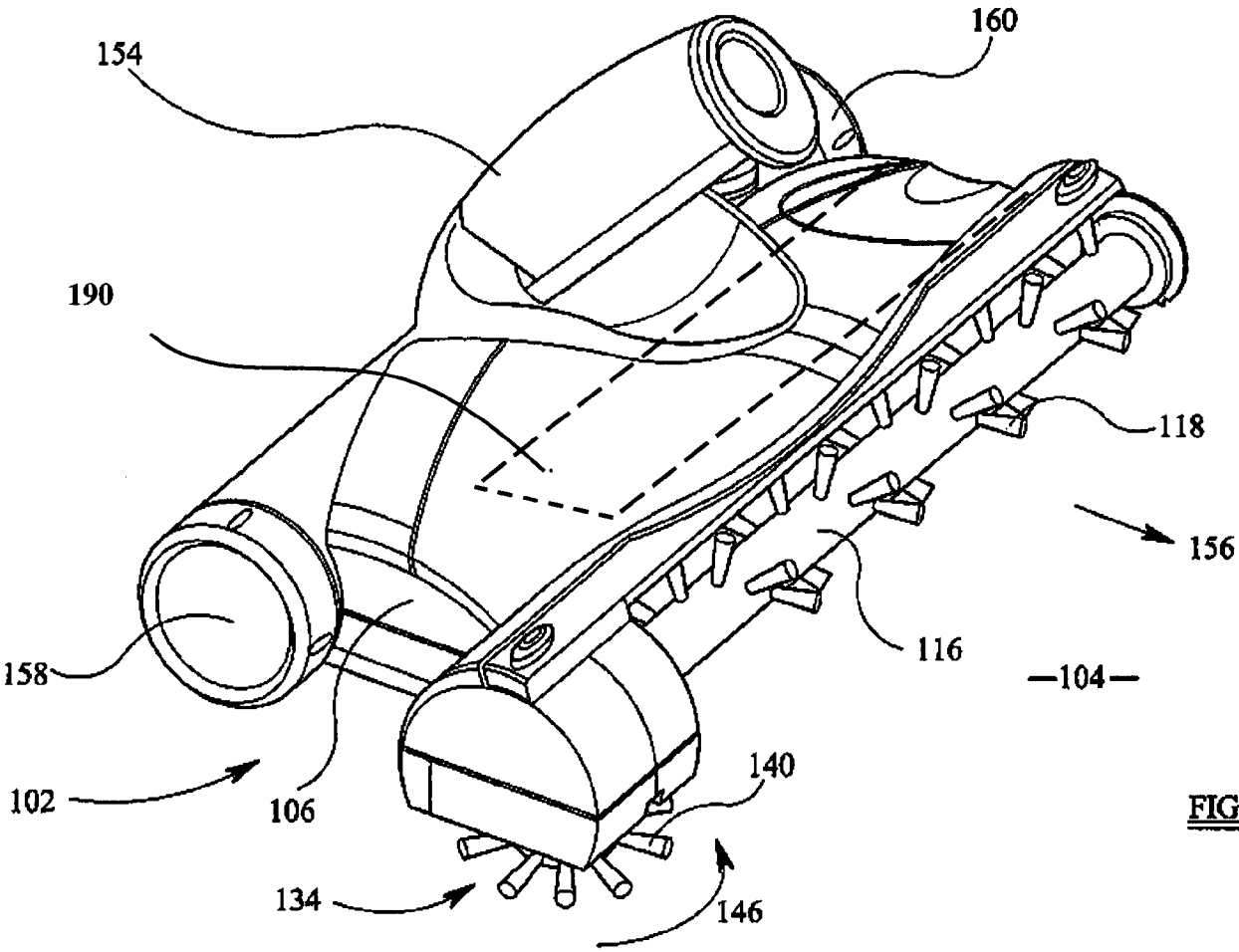
FIG. 4 is a perspective view of another embodiment of surface cleaning apparatus according to the present invention with part of a brush bar cover removed for clarity.
Figure 5:
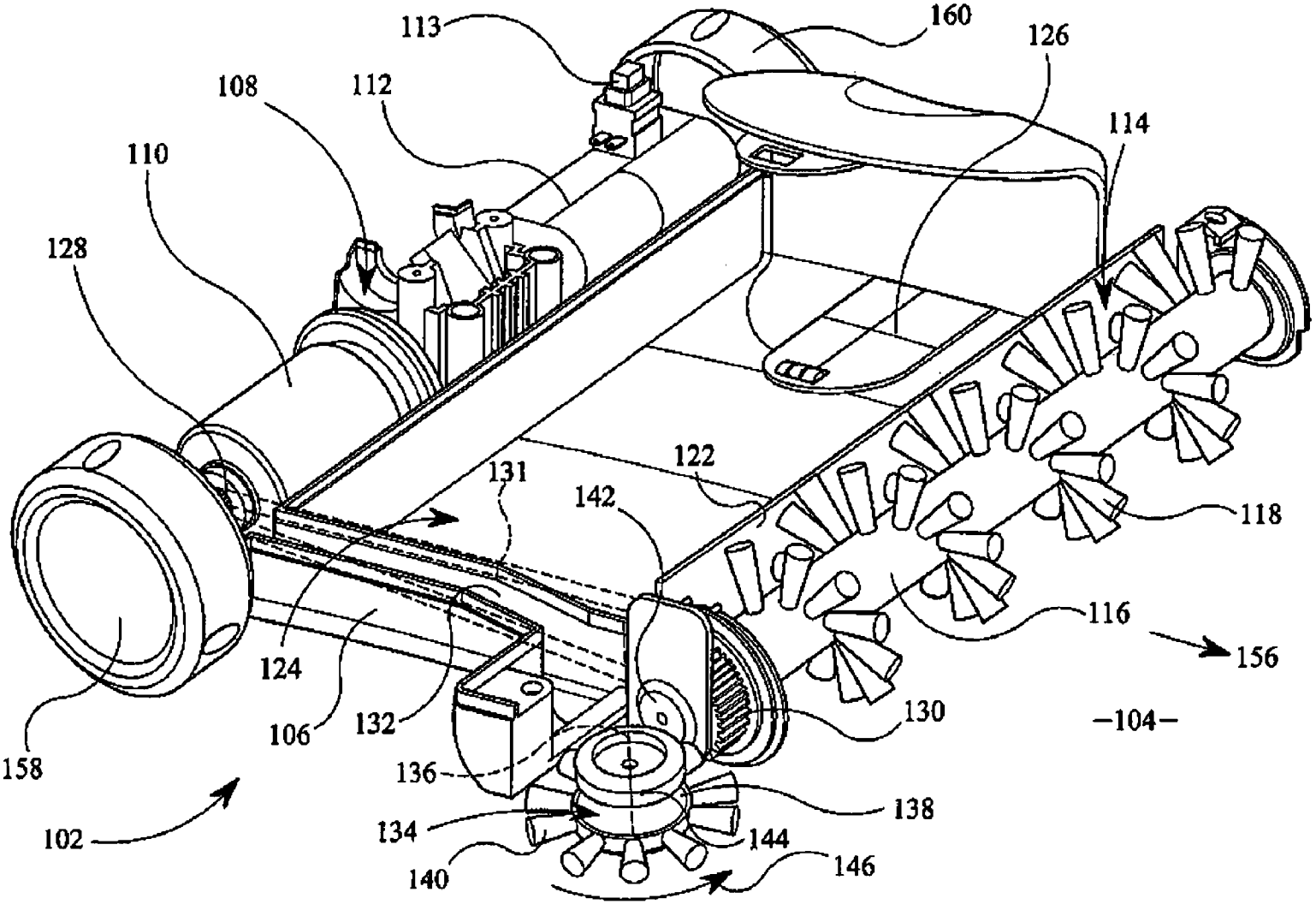
FIG. 5 is a perspective view of the apparatus of FIG. 4, with part of the housing thereof removed.
Figure 6:
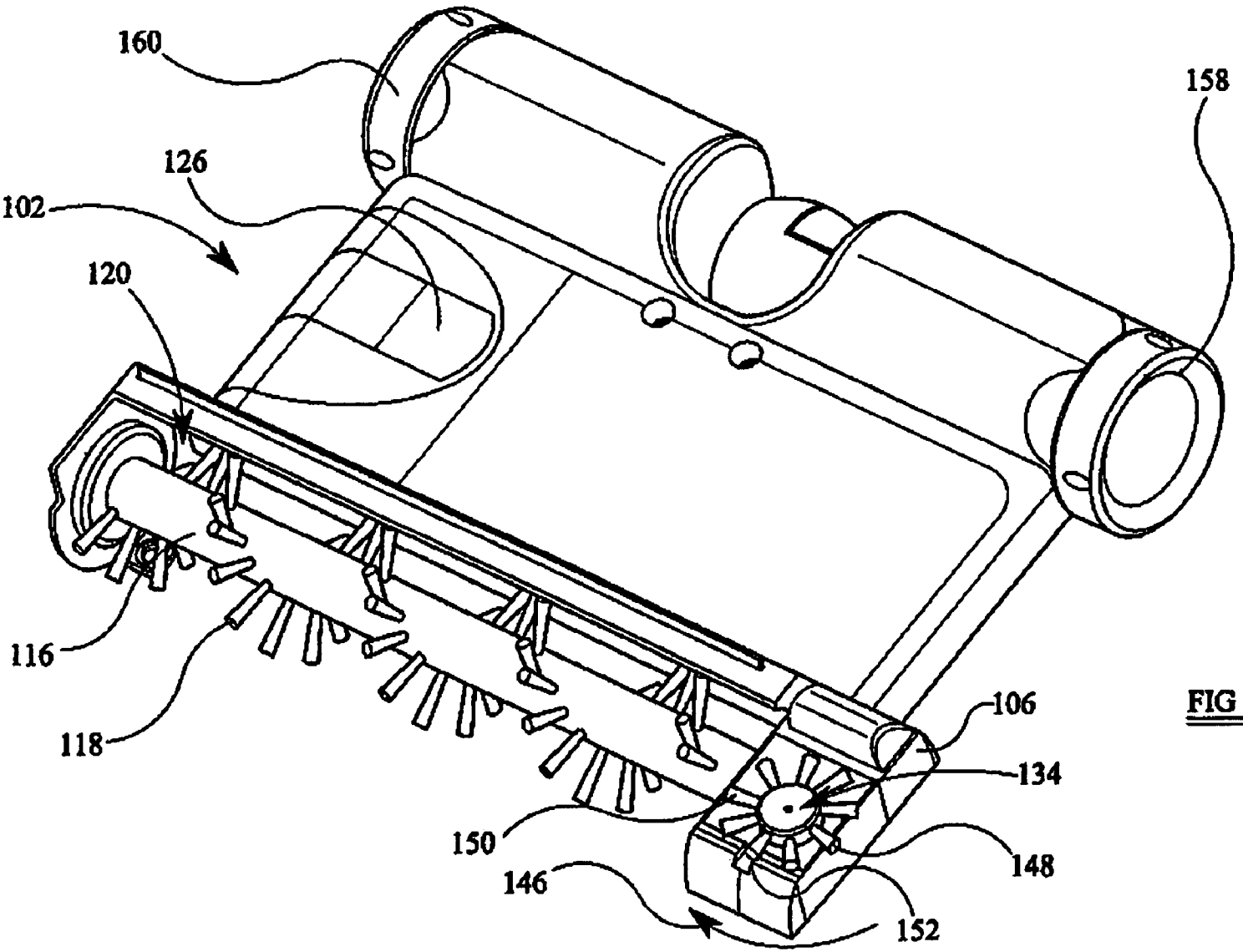
FIG. 6 is an underside view of the apparatus of FIG. 4 with part of the brush bar cover removed for clarity.

Referring to FIGS. 4, 5 and 6, apparatus 102 for cleaning a surface 104 by sweeping comprises a housing 106, suitably of moulded plastic material, and effectively having three compartments. A rear compartment 108 houses an electric motor 110 and a rechargeable battery pack 112. The battery pack 112 may be connected to a main power supply (not shown) for recharging the battery pack. The battery pack may either be connected to the main supply whenever the apparatus is not in use or at suitable times when the battery pack has become depleted. Switch means 113 is provided to permit a user to energize and de-energize the motor 110 as desired. As an alternative to a rechargeable battery pack, the apparatus could employ disposable batteries or be main powered.

A forward compartment 114 (shown with the front part removed) houses a transversely-arranged elongate rotatable brush arrangement 116, with bristles 118. Such elongate rotatable brush arrangement 116 is sometimes known as a brush bar. The bottom of the forward compartment 114 is open at 120 to allow the bristles 118 of the elongate brush arrangement 116 to contact a floor, carpet or the like over which the apparatus is to be propelled. The rear of the forward compartment is a rearwardly inclined wall 122 which allows debris, such as dust, dirt and the like to be propelled up the wall due to rotation of the brush arrangement 116 and to pass over the wall into an intermediate compartment 124. The front of the forward compartment is provided (shown with the front part removed) with a cover (not shown) which may be removable if desired. Debris accumulating in the intermediate compartment 124 can be removed by opening a cover 126. The wall 122 extends upwardly to about the same height as the top of the elongate brush arrangement 116 and may be angled rearwardly (i.e. away from the forward compartment) such as at an angle of about 18 degrees. The precise angle is not important, but the inclination facilitates the passage of the debris up and over the wall 122 and at the same time facilitates retention of the debris within the intermediate compartment 124.

The elongate brush arrangement 116 is rotated by the motor 110 by way of toothed rollers 128, 130 attached to the motor and to the brush arrangement, respectively, and by way of a toothed belt 131, for example of elastomeric material, extending around the two rollers. The toothed belt 131 is enclosed within a tunnel 132 where it passes through or alongside the intermediate compartment 124 in order to prevent the ingress of debris into the rear compartment 108.

An auxiliary brush means 134 is provided extending outwardly from the housing 106 at the right hand side of the elongate rotatable brush arrangement 116 as viewed from above and behind the apparatus 102. The auxiliary brush means 134 is of substantially circular form and is supported for rotation about an axis 136, which may be vertical or inclined to vertical, such as at an angle of about 10 degrees to vertical. The auxiliary brush means 134 has a body 138 provided with radial bristles 140 which are inclined at an acute angle to the axis of rotation 136 so as to effectively form a conical arrangement increasing in cross-section with increasing distance from the body 138.

The auxiliary brush means 134 is rotatably driven from the rotating elongate brush arrangement 116 by a gear wheel 142 at the end of the elongate brush arrangement 116 which meshes with a further gear wheel 144 on the body 138 of the auxiliary brush means 134. The auxiliary brush means 134 is caused to be rotated in an anti-clockwise direction denoted by arrow 146, as viewed from above and behind the apparatus 102. During such rotation of the auxiliary brush means 134, a peripheral region thereof rotates from a sideways-directed position 148 (FIG. 6) outside the housing 106 to an opposed sideways-directed position 150 covered by the housing 106, through a forwardly-directed position 152.

The apparatus 102 is provided with a handle 154 by means of which it can be propelled at least in a forward direction 156. Wheels 158 and 160 are provided to enable or assist manual propulsion of the apparatus across the surface 104 to be swept, such as a floor, stairway or upholstery. The handle 154 could be longer, or be of a different shape or form, as required.

The rotating auxiliary brush means 134 does not rely on contact with the surface 104 for its rotation and therefore provides more efficient sweeping of edge regions of the surface 104 regardless of the nature of the surface 104. Furthermore, the direction of rotation 146 of the auxiliary brush means 134 ensures that debris is swept positively by the auxiliary brush arrangement 134 into a position ahead of the rotating elongate rotating brush assembly 116, ready to be picked up by the elongate brush arrangement 116.

If desired, instead of or in addition to the auxiliary brush means 134 provided extending outwardly from the right hand side of the housing 106, a similar auxiliary brush means (not shown) could likewise be provided extending outwardly from the left hand side of the housing 106 and driven from the opposite end of the elongate brush arrangement 116. Such additional or alternative auxiliary brush means differs from the auxiliary brush means 134 only in that it is caused to rotate in a clockwise, rather than anti-clockwise, direction as viewed from above and behind the apparatus 102.

Instead of the apparatus 102 being provided with a battery or main powered electric motor 110 to drive the elongate brush arrangement 116 and hence the auxiliary brush means 134, a known form of friction drive means (not shown), resulting from propulsion of the apparatus 102 along the surface 104, may be utilised to effect rotation of the elongate brush arrangement 116 and hence rotation of the auxiliary brush means 134.

Figure 7:
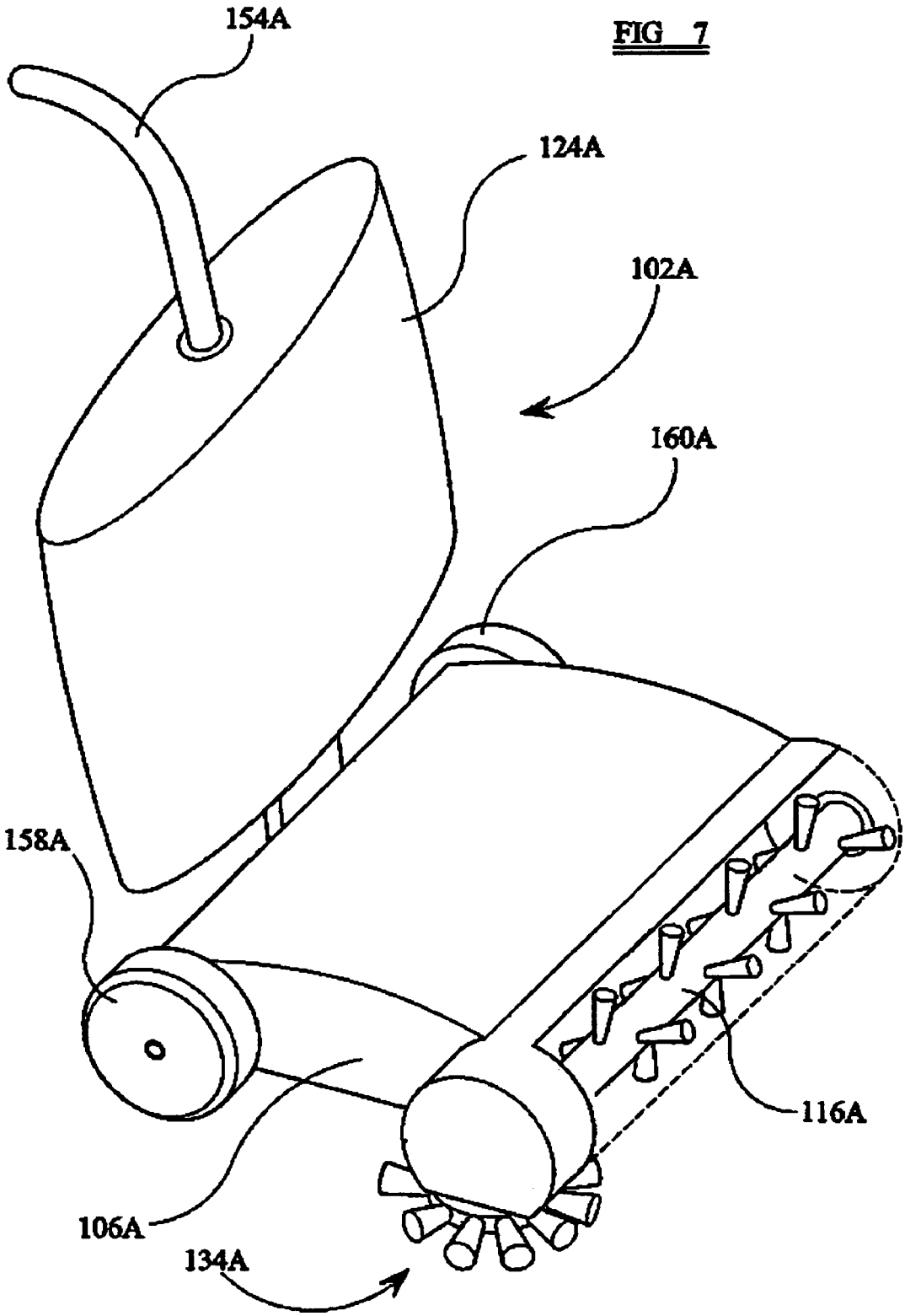
FIG. 7 is a perspective view of an alternative embodiment of surface cleaning apparatus according to the present invention with part of the brush bar cover removed for clarity (shown in dashed lines)

An alternative embodiment of apparatus according to the present invention is shown in FIG. 7. Such alternative embodiment comprises an upright vacuum cleaner apparatus 102A, having a housing 106A with wheels 158A and 160A, a rotating elongate brush arrangement 116A and an auxiliary brush means 134A. The apparatus 102A is constructed in substantially similar manner to the apparatus 102 of FIGS. 4, 5 and 6, with the main exception that instead of the debris-collecting compartment 124 of FIG. 5, a debris-collecting container 124A, which may include a bag, is provided between a handle 154A and the housing 106A and connected by a well-known form of suction arrangement (not shown) to the housing 106A.

Figure 8:
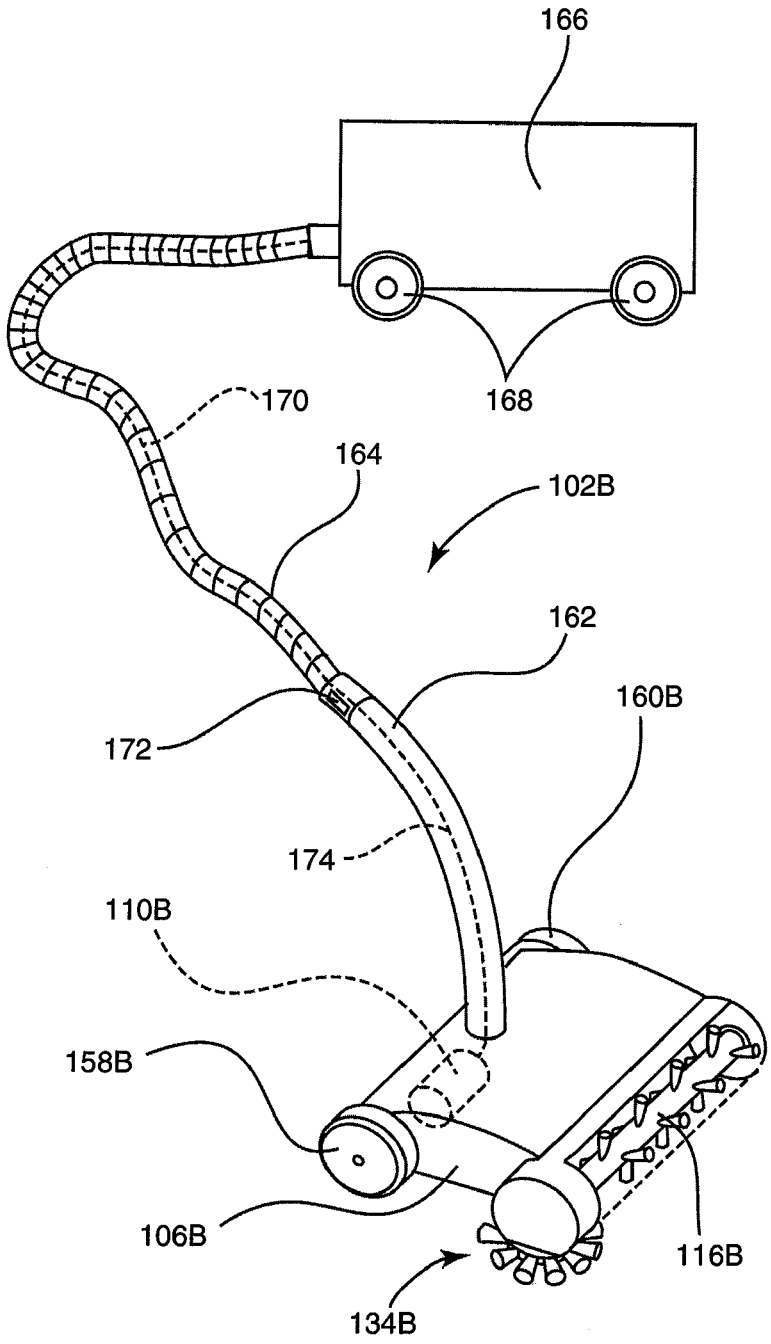
FIG. 8 is a perspective view of a further embodiment of surface cleaning apparatus according to the present invention with part of the brush bar cover removed for clarity (shown in dashed lines).

A further embodiment of apparatus 102B according to the present invention is shown in FIG. 8. Here the housing 106B incorporates components similar to those of the housing 106 of FIGS. 4, 5 and 6 including wheels 158B and 160B, in particular, an elongate rotating brush arrangement 116B with an auxiliary rotating brush means 134B driven therefrom. However, no debris-collecting compartment is provided inside the housing 106B. Instead, the housing 106B is provided with a tubular portion 162 which is demountable on, or may be fixed to, a debris-receiving flexible hose 164 connected to a well-known form of suction vacuum cleaner 166, which may be of cylinder form, mounted on wheels 168. Electrical wiring 170 can be incorporated in the hose 164 by means of which main electrical power can be supplied from the vacuum cleaner 166, and through a connector 172 and wiring 174 in the tubular portion 162, to an electric motor 110B where provided in the housing 106B for driving the elongate rotating brush arrangement 116B and the auxiliary brush means 134B. Of course, such wiring 170 would be unnecessary where the elongate brush arrangement 116B and the auxiliary brush means 134B driven therefrom, is caused to be rotated by the friction means previously described. Alternatively, the elongate brush arrangement 116B and the auxiliary brush means 134B may be caused to be rotated by means of a (rechargeable) battery or an air turbine driven by air passing along the tubular portion 162. The housing 106B with its included components could be provided as an accessory for existing vacuum cleaners of cylinder form.

What is claimed is:

1. A surface cleaning apparatus, comprising:

a body having a forward compartment and rear compartment;

an elongate rotatable brush having bristles and extending across the forward compartment, the elongate rotatable brush further comprising a gear wheel at least one end of the brush;

an auxiliary brush extending from the forward compartment, the auxiliary brush having a body comprising a gear wheel that meshes with the elongate rotatable brush gear wheel for rotatably driving the auxiliary brush by the elongate rotatable brush; and a belt connecting an electric motor and the rotatable brush;

wherein a front part of the forward compartment is movable to expose bristles on the elongate rotatable brush at the front part of the forward compartment.

2. The apparatus of claim 1, further comprising an intermediate compartment defined by a wall between the forward compartment and the intermediate compartment, a wall between the intermediate compartment and the rear compartment, and side walls.

3. The apparatus of claim 2, wherein one side wall is removable to facilitate removal of debris.

4. The apparatus of claim 3, wherein the removable side wall includes a cover.

5. The apparatus of claim 3, wherein the belt is enclosed within a tunnel that passes through the intermediate compartment.

6. The apparatus of claim 5, wherein the tunnel is arranged at a side remote from the removable side wall.

7. The apparatus of claim 2, wherein the intermediate compartment includes a tray that can be removed and emptied so as to discharge debris.

8. The apparatus of claim 2, wherein the wall between the forward and intermediate compartments is inclined rearwardly.

9. The apparatus of claim 8, wherein the wall between the forward and intermediate compartments has an angle of inclination of from 15 to 20 degrees.

10. The apparatus of claim 2, wherein the wall between the intermediate and rear compartments seals the rear compartment from the intermediate compartment.

11. The apparatus of claim 1, further comprising a handle rotatable about an axial direction of the handle attached to the body to facilitate steering of the apparatus.

12. The apparatus of claim 11, wherein the handle is further pivotable about an axis transverse to the axial direction of the handle.

13. The apparatus of claim 11, wherein the handle is attached to the body in a region of the rear compartment.

14. The apparatus of claim 1, further comprising a motor switch located at the rear of the body to control operation of the motor.

15. The apparatus of claim 1, wherein the forward compartment further comprises an opening in a lower surface thereof, and wherein a lower front region of the body is chamfered so that bristles of the elongate brush protrude from the body in the region of the chamfer such that, when the apparatus is inclined relative to a surface to be cleaned, contact between the bristles and the surface to be cleaned is increased.

16. The apparatus of claim 1, wherein the electric motor is located in the rear compartment.

17. The apparatus of claim 1, wherein the auxiliary brush comprises radial bristles which are inclined at an acute angle to the axis of rotation.

18. The apparatus of claim 1, wherein the auxiliary brush is supported for rotation about an axis inclined relative to vertical.

19. A surface cleaning apparatus comprising:

a body having a forward compartment with an opening in a lower surface thereof, and a rear compartment;

an elongate rotatable brush extending across the forward compartment, the elongate rotatable brush having bristles adapted to extend through the opening in the forward compartment as the brush is rotated, with the elongate rotatable brush further comprising a gear wheel at an end of the brush;

an intermediate compartment defined by a wall between the forward compartment and the intermediate compartment, with a wall between the intermediate compartment and the rear compartment, and side walls;

a belt connecting an electric motor to the rotatable brush; and an auxiliary brush extending from the forward compartment, the auxiliary brush having a body comprising a gear wheel that meshes with the elongate rotatable brush gear wheel for rotatably driving the auxiliary brush by the elongate rotatable brush, wherein a lower front region of the body is chamfered to increase the extent to which the bristles protrude from the body in the region of the chamfer such that, when the apparatus is inclined relative to a surface to be cleaned, contact between the bristles and the surface to be cleaned is increased.

20. The apparatus of claim 19, wherein the electric motor is located in the rear compartment.

21. The apparatus of claim 19, wherein one side wall is removable to facilitate removal of debris.

22. The apparatus of claim 21, wherein the removable side wall includes a cover.

23. The apparatus of claim 21, wherein the belt is enclosed within a tunnel that passes through the intermediate compartment.

24. The apparatus of claim 23, wherein the tunnel is arranged at a side remote from the removable side wall.

25. The apparatus of claim 19, wherein the intermediate compartment includes a tray that can be removed and emptied so as to discharge debris.

26. The apparatus of claim 19, wherein the wall between the forward and intermediate compartments is inclined rearwardly.

27. The apparatus of claim 26, wherein the wall between the forward and intermediate compartments has an angle of inclination of from 15 to 20 degrees.

28. The apparatus of claim 19, wherein the wall between the intermediate and rear compartments seals the rear compartment from the intermediate compartment.

29. The apparatus of claim 19, further comprising a handle rotatable about an axial direction of the handle attached to the body to facilitate steering of the apparatus.

30. The apparatus of claim 29, wherein the handle is further pivotable about an axis transverse to the axial direction of the handle.

31. The apparatus of claim 29, wherein the handle is attached to the body in a region of the rear compartment.

32. The apparatus of claim 19, further comprising a motor switch located at the rear of the body to control operation of the motor.

33. The apparatus of claim 19, wherein a front part of the forward compartment is movable to expose bristles on the elongate rotatable brush at the front part of the forward compartment.

34. The apparatus of claim 19, wherein the auxiliary brush comprises radial bristles which are inclined at an acute angle to the axis of rotation.

35. The apparatus of claim 19, wherein the auxiliary brush is supported for rotation about an axis inclined relative to vertical.

36. A surface cleaning apparatus, comprising:

an elongate rotatable brush having bristles and extending across a forward compartment of the apparatus, wherein the forward compartment includes a rearwardly angled wall and the elongate rotatable brush is positioned to propel debris up the wall;

an electric motor attached to the apparatus and in connection with the elongate rotatable brush to rotate the elongate rotatable brush;

a gear wheel at an end of the elongate rotatable brush; and an auxiliary brush extending from the forward compartment, supported for rotation about an axis, and having a body comprising a gear wheel that meshes with the gear wheel at the end of the elongate rotatable brush without an intervening gear to rotatably drive the auxiliary brush by the elongate rotatable brush.

37. The apparatus of claim 36, wherein the apparatus includes a tray that can be removed and emptied so as to discharge debris.

38. The apparatus of claim 36, wherein the auxiliary brush comprises radial bristles which are inclined at an acute angle to the axis of rotation.

39. The apparatus of claim 36, wherein the auxiliary brush is supported for rotation about an axis inclined relative to vertical.

40. The apparatus of claim 36, wherein the apparatus has a lower front region that is chamfered to increase the extent to which the bristles protrude from the body in the region of the chamfer such that, when the apparatus is inclined relative to a surface to be cleaned, contact between the bristles and the surface to be cleaned is increased.

* * * * *